US005081926A

United States Patent [19]

Rodi

[11] Patent Number: 5,081,926

[45] Date of Patent: Jan. 21, 1992

[54] METHOD AND APPARATUS FOR THE RAPID ESTABLISHMENT OF AN INK ZONE PROFILE IN AN OFFSET PRINTING PRESS

[75] Inventor: Anton Rodi, Leimen, Fed. Rep. of Germany

[73] Assignee: Heidelberger Druckmaschinen AG, Heidelberg, Fed. Rep. of Germany

[21] Appl. No.: 540,612

[22] Filed: Jun. 19, 1990

[30] Foreign Application Priority Data

Jun. 19, 1989 [DE] Fed. Rep. of Germany ..... 3919922
Apr. 28, 1990 [DE] Fed. Rep. of Germany ..... 4013740

[51] Int. Cl.[5] ..... B41F 7/04; B41F 7/26

[52] U.S. Cl. ..... 101/211; 101/137; 101/148

[58] Field of Search ..... 101/142, 144, 145, 136, 101/137, 140, 141-148, 349, 350, 351, 352, 492, 483, 211

[56] References Cited

U.S. PATENT DOCUMENTS 3,056,346 10/1962 Gammeter et al. ..... 101/144
3,771,446 11/1973 Kaneko et al. ..... 101/144
4,000,692 1/1977 Wirz ..... 101/148
4,434,716 3/1984 Ishii et al. ..... 101/142
4,660,470 4/1987 Kramp et al. ..... 101/426

FOREIGN PATENT DOCUMENTS 2202490 9/1988 United Kingdom .

*Primary Examiner*—J. Reed Fisher
*Attorney, Agent, or Firm*—Nils H. Ljungman & Associates

[57] ABSTRACT

An offset printing press having a wetting unit and an inking unit which has an ink metering device to set an ink profile, the inking unit and the wetting unit each having at least one applicator roller which can be moved into a position in contact with a printing plate mounted on a plate cylinder. To generate an ink profile which is very close to that required for the printing run and to reduce waste, the applicator rollers are moved by a control apparatus into a position of contact with the printing plate during the establishment of the ink zone profile which occurs before the beginning of printing, or during a jam or a blanket washing process which interrupts the printing process. A corresponding process is also described.

17 Claims, 8 Drawing Sheets

METHOD AND APPARATUS FOR THE RAPID ESTABLISHMENT OF AN INK ZONE PROFILE IN AN OFFSET PRINTING PRESS

BACKGROUND OF THE INVENTION

1. Field of the Invention

The present invention relates to an offset printing press having a wetting unit and an inking unit, the inking unit having an ink metering apparatus for the establishment of an ink profile, and wherein the inking unit and the wetting unit each have at least one applicator roller which can be moved into a contact position with a printing forme. As used herein, the term "printing forme" refers to an image bearing medium, the image on which is to be printed, e.g., a plate cylinder and/or a printing plate.

2. Background Information

On offset printing presses, it is often necessary to have a thin film of ink fed to the printing forme which has been wetted with a wetting agent. For this purpose, there may be provided an inking unit equipped with a number of rollers. The delivery of the wetting agent may be accomplished by means of a wetting unit, which also has an arrangement of rollers. Depending upon the image provided on the printing forme, it is desirable to establish an appropriate and corresponding ink distribution in a direction transverse to the direction of travel of the material to be printed through the offset printing press, to achieve a good printing result. Accordingly, the inking unit is preferably provided with an ink metering device which makes possible the zonal setting of an ink profile. The thickness of the ink layer in the individual zones is established as a function of the requirements for the individual zones. The ink is delivered by means of an ink ductor from an ink pan or reservoir. It is up to the printer to make the zonally required adjustment of the ink metering device as a function of the ink requirements of the image in question. This is done when setting up the offset printing press. Additionally, before the actual printing, a so-called "ink admission" (or "ink profile establishment") is conducted, in which the above-mentioned profiled ink film is built up inside the inking unit. In known prior art devices, during the ink profile establishment period, movable applicator rolls may assume a position where they are separated by some distance from the printing forme, so that there is not yet any inking of the image. The printing forme preferably consists of a plate cylinder, on the convex surface of which a printing plate bearing air image is mounted.

In addition to the ink distribution in the circumferential direction, the ink is also distributed laterally, to some degree, during the ink admission (or ink profile establishment), preferably, by laterally reciprocating (or oscillating) distribution rollers. Consequently, the ink remains pliant (or flexible) and is also uniformly distributed laterally. Undesirable accumulations of ink can also be avoided. However, the lateral distribution (or spreading by rubbing) during the ink profile establishment may, for example, lead to a situation where the ink profile constructed by the ink metering device is evened out to a certain extent once again, so that, in the start-up phase of the subsequent printing process, the lateral ink profile may not be available to the desired extent. Moreover, initially the ink distribution does not satisfactorily correspond to the image, which leads to the generation of waste sheets. Only when the appropriate printing run conditions are achieved, i.e., when an ink profile which properly corresponds to the image has been established, are good printing results achieved.

The problems described above also exist when a so-called "jam" occurs, i.e., a short interruption of the printing process, and also during a pause in the printing run to wash the blanket cylinder of the offset printing press, since, when the printing process is restarted, there will initially be a somewhat unsatisfactory ink profile.

German Published Patent Application No. 37 06 695 discloses a process for the generation of a defined ink distribution in the inking unit of rotary printing machines which is close to the ink profile required for the printing run, and in which, before the beginning of printing, first the ink profile present in the inking unit from the preceding printing job is removed, while the unit is rotating, by closing the ink metering elements and by the return feed into the ink reservoir of the amounts of ink present in the inking unit as a function of the profile, so that a basically constant thickness ink layer remains, the thickness of which is independent of the profile. Then the ink profile required for the subsequent printing job is generated in the inking unit by a zonal adjustment of the ink metering elements with a defined number of revolutions of the inking unit rollers.

Published German Patent Application No. 33 38 143 discloses a presetting of the inking unit. To generate a defined distribution of the ink in the inking unit which is close to that required for the printing run, a precisely measured quantity of ink is transported to the inking unit rollers before the beginning of printing by means of the vibrator rollers, so that a pre-determined distribution of ink layer thicknesses is established upon the rollers of the inking unit.

Published German Patent Application No. 15 61 100 discloses an inking unit for rotary printing presses which has controllable lifting means, to separate defined groups of rollers. These lifting means also move the applicator rollers which interact with the printing forme. When there is an interruption of the printing, the lifting means bring about a separation of certain groups of rollers, and also shut off the applicator rollers.

OBJECT OF THE INVENTION

One object of the present invention is, therefore, the provision of an offset printing press in which an ink distribution close to that required for the printing run can be established very quickly, so that waste can be eliminated as much as possible.

SUMMARY OF THE INVENTION

This and other objects are achieved by means of the present invention, in that, for the generation of an ink profile close to that required for the printing run, the applicator rollers are continuously or temporarily moved, during the admission of the ink and before the beginning of printing, or during a jam or blanket washing process interrupting one of the printing processes, by a control apparatus, into a position where they are in contact with the printing forme. Therefore, during at least a portion of the period when the machine is not printing, the rotating application rollers of the inking unit and the wetting unit do not assume the position of the prior art, where they are separated from the rotating printing forme, but, according to the invention, they remain, for a determinate period of time, in a contacting position. Consequently, the image of the printing plate supports the ink distribution such that an ink profile which largely corresponds to the image is established. Simultaneously, the zonal ink profile established in the ink metering apparatus, but which has been evened out to a certain extent by the smoothing action of the rollers, is reestablished by the invention, in particular on the applicator rollers, by means of alternate or reverse action with the printing plate, so that, when the printing resumes and immediately thereafter, a zonal ink feed can be established which meets the profile requirements. Preferably, and in accordance with the invention, not only the applicator rollers of the inking unit, but also the applicator rollers of the wetting unit assume a position where they are in contact with the printing forme, to produce the desired reverse action process, and also to prevent a coloration of sections of the image which are normally free of ink.

In one preferred embodiment of the invention, during the admission of the ink, during a jam or during a blanket washing process, the control apparatus reduces the quantity of wetting agent delivered, compared to the quantity delivered during the printing run. In this manner, an excess of wetting agent on the printing plate is prevented. Preferably, the feed of wetting agent is set at a value which makes up for any losses which occur (e.g. by evaporation), so that an equilibrium is achieved.

The proper metering of wetting agent adjusted to the current operating conditions is performed by the control apparatus, by adjusting the number of revolutions and/or speed of rotation of a wetting fountain roller. A portion of the circumference of the wetting fountain roller is in contact with the wetting agent, and transfers the amount of wetting agent transported by it to a downstream metering roller of the wetting unit. In addition to the adjustment of the amount of wetting agent transported through adjustment of the number of rotations and/or speed of the fountain roller, an influence can also be exerted by means of the pressure between the fountain roller and the metering roller, and by an inclination of the above-mentioned rollers in relation to one another.

In another preferred embodiment of the invention, simultaneous with or subsequent to the inking- of the printing forme produced by the contact between the applicator rollers and the printing forme, the blanket of a blanket cylinder of the offset printing machine is also inked. In addition to the inking of the printing forme by the contact between the applicator rollers of the inking unit and wetting unit, a feature is created here which assists the rapid achievement of proper conditions for the print run. As a result of the interaction between the blanket and the printing forme, a positive influence is also exerted on the ink distribution, so that the generation of an ink distribution which is close to the ink distribution profile required for the printing run is quickly accomplished.

Preferably, in this embodiment of the invention, the inking of the blanket is achieved by the assumption of a contact position between the inked printing forme and the blanket of the blanket cylinder. The blanket and the printing forme are thereby in positions where they are in contact with one another, but the printing operation of the offset printing press is not yet resumed, because the inking of the blanket takes place before the beginning of the actual printing.

To prevent the printing cylinder of the offset printing press from becoming soiled with the ink/water emulsion during the inking of the blanket, the printing cylinder may assume a position in which it is separated from the blanket or blanket cylinder. In one embodiment of the invention, the blanket cylinder 40 and the plate cylinder 33 are separated from one another during the inking of the printing forme 32, while, in another embodiment of the invention, the blanket cylinder 40 and the plate cylinder 33 are in contact with one another for a portion of the period of time during which the printing forme 32 is being inked. It is thereby possible, with the use of modern, commercially available printing machines, for the purpose of inking the blanket, to change the printing machine into its printing operation position, but without beginning the printing operation, whereby (in contrast to the normal printing operation position) a printer feed adjustment acting between the blanket cylinder and the printing cylinder is moved out of its current working range in the printing run position, so that the blanket of the blanket cylinder and the printing cylinder assume positions in which they are separated. Therefore, the printer feed adjustment, which has previously used to compensate for different paper thicknesses, is given a new application in the invention, in that, in addition to its normal range of operation, it effects a relative movement between the blanket cylinder and the printing cylinder, so that the inked blanket does not come into contact with the printing cylinder.

Additionally or alternatively, however, it is also possible, in addition to the print feed adjustment used for the paper thickness compensation, to have an additional device which brings about the separation between the blanket cylinder and the printing cylinder. However, the inclusion of such an additional device then requires additional design measures. In other words, the machines of the prior art must be equipped with a corresponding device.

The above-described method for the generation of an ink distribution which is very close to that required for the printing run is based on the fact that, simultaneous with or subsequent to the inking of the printing forme, when the applicator rollers and printing forme are in the contacting position, an inking of the blanket takes place by the assumption of a contact position between the printing forme and the blanket of a blanket cylinder, whereby in particular, by means of a print feed adjustment, the printing cylinder of the offset printing machine is moved into a position where it is separated from the blanket cylinder. In particular, the separation of the blanket cylinder and printing cylinder is maintained during several revolutions of the blanket cylinder. The blanket is then inked for a corresponding period of time.

The present invention also relates to a process for the generation, in the inking unit of an offset printing press, of an ink distribution which is very close to that required for the printing run, the printing press having an ink metering apparatus for setting the ink profile, and having applicator rollers of an inking unit and a wetting unit which can be moved into a position where they are in contact with a printing forme, wherein the applicator rollers are moved into a contacting position with the printing forme during the admission of the ink which takes place before the beginning of printing, or during a jam or blanket washing process which interrupts the printing run. During the admission of the ink, during the jam or during the blanket washing process, the quantity of wetting agent which is supplied can be reduced from the quantity supplied during the printing run. The adjustment of the ink metering apparatus is made by the printer as a function of the image and, preferably, remains unchanged as long as the applicator rollers remain in the contacting position. In accordance with one particular embodiment, however, it is also possible for the ink metering apparatus to be automatically adjusted, in coordination with the wetting unit control and the applicator rollers, by means of an ink control apparatus, as a function of the operating conditions, so that optimal conditions are created for the printing run.

The invention is explained in greater detail below and with reference to the accompanying figures.

One aspect of the invention resides boadly in a method for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing operation of the offset printing press, the printing press comprising a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, said method comprising the steps of: metering the ink, from said ink reservoir and through said ink metering apparatus, to said ink roller train: operating said ink roller train to transport the ink metered through said ink metering device to the printing plate mounted on the plate cylinder; operating said wetting agent roller train to transport the wetting agent from the wetting agent reservoir to the printing plate mounted on the plate cylinder: during said operation of said ink roller train, and during said operation of said wetting agent roller train, and prior to said printing operation of said printing press, maintaining at least one of said at least one ink applicator roller and said at least one wetting agent applicator roller in contact with said printing plate mounted on the plate cylinder for a determinate period of time to thereby transfer fluid from at least one of said at least one ink applicator roller and said at least one wetting agent applicator roller to said printing plate; initiating said printing operation of said printing press; and completing said printing operation of said printing press.

Another aspect of the invention resides broadly in a method for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing operation of the offset printing press, the printing press comprising a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, said method comprising the steps of: metering the ink, from said ink reservoir and through said ink metering apparatus, to said ink roller train: operating said ink roller train to transport the ink metered through said ink metering device to the printing plate mounted on the plate cylinder; operating said wetting agent roller train to transport the wetting agent from the wetting agent reservoir to the printing plate mounted on the plate cylinder: during said operation of said ink roller train, and during said operation of said wetting agent roller train, and prior to said printing operation of said printing press, maintaining at least one of said at least one ink applicator roller and said at least one wetting agent applicator roller in contact with said printing plate mounted on the plate cylinder for a determinate period of time to thereby transfer fluid from at least one of said at least one ink applicator roller and said at least one wetting agent applicator roller to said printing plate; initiating said printing operation of said printing press: and completing said printing operation of said printing press: said method comprising the further step of, during the establishment of said ink zone profile, reducing the flow of wetting agent transported from the wetting agent reservoir to the printing plate mounted on the printing cylinder to a flow of wetting agent which is substantially less than the flow of wetting agent transported during the subsequent printing operation of said printing press; wherein the printing press additionally comprises: a blanket cylinder positioned adjacent said plate cylinder; and blanket cylinder positioning means; said blanket cylinder positioning means being for moving said blanket cylinder between at least a first position, in which said first position said blanket cylinder is in a contacting relationship with said plate cylinder, and a second position, in which said second position said blanket cylinder is in a noncontacting relationship with said plate cylinder; and wherein said method comprises the additional step of: inking said blanket cylinder by contacting said blanket cylinder with said plate cylinder, following the initiation of contact of said at least one of said at least one ink applicator roller and said at least one wetting agent applicator roller with said printing plate, and prior to said printing operation of said printing press; said method further comprising the additional steps of: maintaining said at least one wetting agent applicator roller in contact with said printing plate; rotating said at least one wetting agent applicator roller a predetermined number of rotations prior to initiating said printing operation of said printing press; and completing said printing operation of said printing press; wherein said transferring of fluid from at least one of said at least one ink applicator roller and said at least one wetting agent applicator roller continues for a period of time in the range of about 6 minutes prior to feeding paper through said printing press; wherein said offset printing press additionally comprises wetting agent fountain rollers means for transferring the wetting agent from said wetting agent reservoir to said wetting roller train, and wherein said method additionally comprises the further step of varying the rotational speed of said wetting agent fountain roller means during the establishment of said ink zone profile; wherein said offset printing press additionally comprises a printing cylinder and selective adjustment means for adjusting between a first position wherein said blanket cylinder and said printing cylinder are in a contacting relationship and a second position wherein said blanket cylinder and said printing cylinder are spaced from one another in a noncontacting relationship, and wherein, during the inking of said blanket cylinder by the contact of said blanket cylinder with said plate cylinder, said blanket cylinder and said printing cylinder are in said second position, spaced from one another in said noncontacting relationship; and wherein said selective adjustment means comprises print feed adjustment means.

Yet another aspect of the invention resides broadly in an offset printing press control for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing press run, the printing press comprising a plate cylinder for receiving the mounting thereon of the printing plate, an ink reservoir for supplying the ink, an ink roller train comprising at least one ink applicator roller for transferring at least a portion of the ink supplied by the ink reservoir to the printing plate mounted upon the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, said offset printing press control comprising: means for metering the ink, from the ink reservoir and through said ink metering apparatus, to said ink roller train; means for operating said ink roller train to transport the ink metered through said ink metering device to the printing plate mounted on the plate cylinder; means for operating said wetting agent roller train to transport the wetting agent from the wetting agent reservoir to the printing plate mounted on the plate cylinder; control means for retracting at least one of said at least one ink applicator roller and said at least one wetting agent applicator roller from said printing plate, said control means having additional control means for contacting at least one of said at least one ink applicator roller and said at least one wetting agent applicator roller with said printing plate; and means for maintaining at least one of said at least one ink applicator roller and said at least one wetting agent applicator roller in contact with said printing plate mounted on the plate cylinder for a determinate period of time and for transferring fluid from at least one of said at least one ink applicator roller and said at least one wetting agent applicator roller to said printing plate; and further control means for initiating said printing operation of said printing press.

A further aspect of the invention resides broadly in a method for the rapid establishment of an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing operation of the offset printing press, the printing press comprising a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a blanket cylinder positioned adjacent the plate cylinder, and blanket cylinder adjustment means for moving the blanket cylinder between a first position wherein the blanket cylinder is in contact with the plate cylinder and a second position wherein the blanket cylinder is not in contact with the plate cylinder, said method comprising the steps of: metering the ink, from the ink reservoir and through said ink metering apparatus, to said ink roller train; operating said ink roller train to transport the ink metered through said ink metering device to the printing plate mounted on the plate cylinder inking said printing plate by contacting said at least one ink applicator roller with said printing plate; and prior to said printing operation, contacting said blanket cylinder with said printing plate for a determinate period of time.

A yet further aspect of the invention resides broadly in a method for establishing an ink zone profile in a printing press, said printing press being for the production, during a printing press run, of successive prints of an image provided on a printing plate, the successive prints of the image being formed by the deposition of an ink on a printing medium, the ink zone profile being established in the printing press prior to the execution of the printing press run, the printing press comprising a plate cylinder for receiving the mounting thereon of the printing plate, an ink reservoir for supplying the ink, at least one ink applicator roller for transferring at least a portion of the ink supplied by the reservoir to the printing plate mounted on the plate cylinder, a wetting agent reservoir for supplying a wetting agent, and at least one wetting agent applicator roller for transferring at least a portion of the wetting agent supplied by the wetting agent reservoir to the printing plate mounted upon the printing cylinder, said method comprising the steps of: during the establishment of said ink zone profile, and prior to said printing press run, maintaining at least one of said at least one ink applicator roller and said at least one wetting agent applicator roller in contact with said printing plate mounted on the plate cylinder for a determinate period of time; and transferring fluid from at least one of said at least one ink applicator roller and said at least one wetting agent applicator roller to said printing plate.

DESCRIPTION OF THE PREFERRED EMBODIMENT

Figure 1:
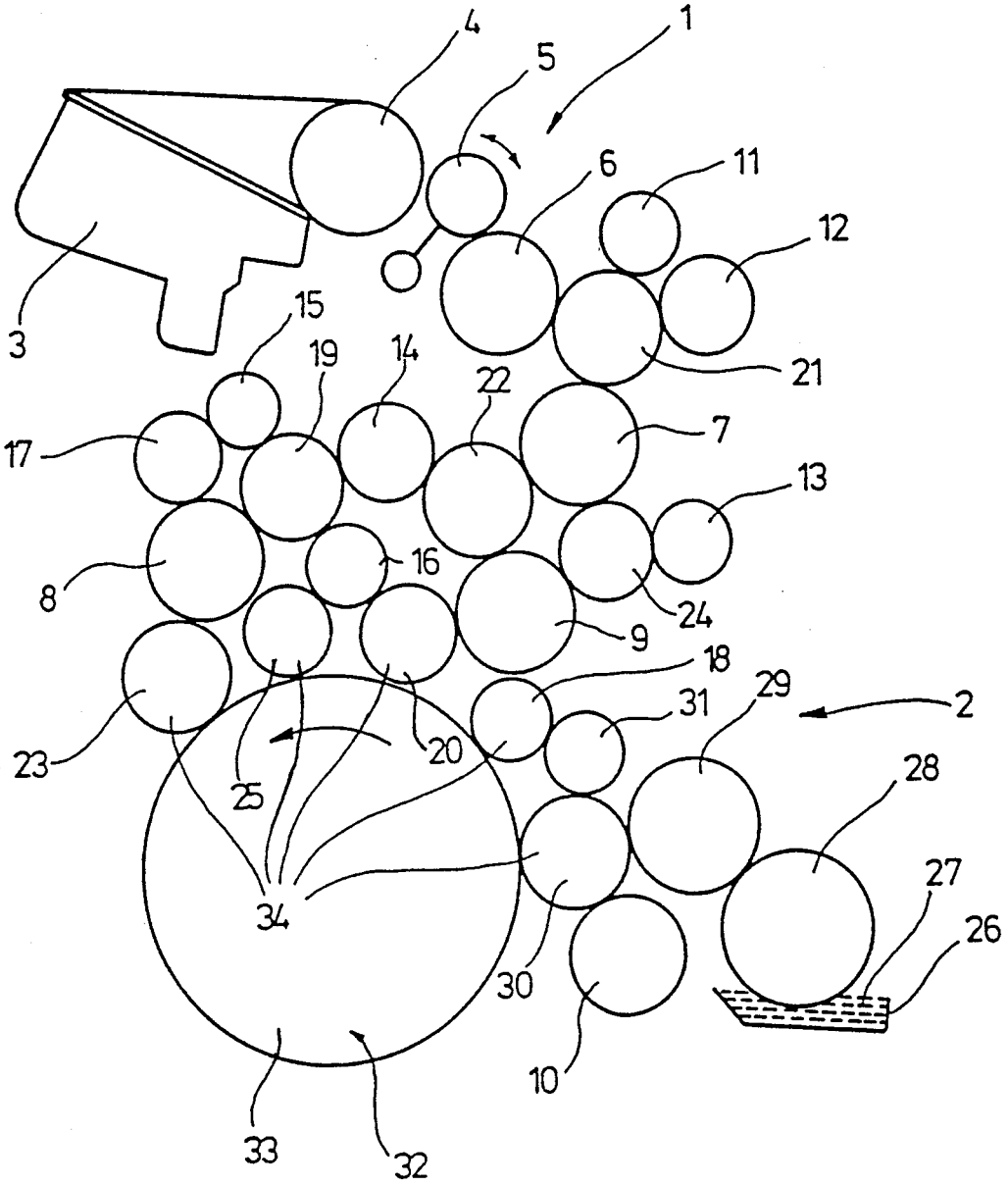
FIG. 1 is a schematic diagram of the rollers of an offset printing press, with the applicable rollers of an inking unit and a wetting unit moved into a position where they are in contact with a printing cylinder.

FIG. 1 is a schematic illustration of an offset printing press having an inking unit 1 and a wetting unit 2. The inking unit 1 has an ink pan or ("ink reservoir") 3 with an ink metering device, from which an ink ductor extracts measured amounts of ink during operation. A fountain roller 5 interacts with an ink ductor roller 4 and with a driven distributing cylinder 6. The inking unit and the wetting unit 1 and 2 also have additional, preferably driven, distributing cylinders 7, 8, 9, 10. There are also six riding rollers and transfer rollers 11 to 16 and two rubber rollers 17 and 18. The inking unit 1 also has two rubber rollers 19 and 20, and three additional, larger-diameter rubber rollers 21 to 23. There are also two rubber rollers 24 and 25 which have diameters which are smaller than those of the rubber rollers 19 and 20.

The wetting unit 1 has a reservoir 26, which is filled with a wetting agent, and in which a portion of the circumference of a wetting fountain roller 28 is immersed. The wetting fountain roller 28 interacts with a wetting agent metering roller 29. There is also provided a rubber roller 30 and an intermediate roller 31.

By means of the arrangement of rollers described above, both ink and the wetting agent are transported to a printing forme 32. The printing forme 32 is configured as a plate cylinder 33, on the circumference of which there is clamped a printing plate having an image thereon, well known in the art and therefore not described in any further detail.

Figure 2A:
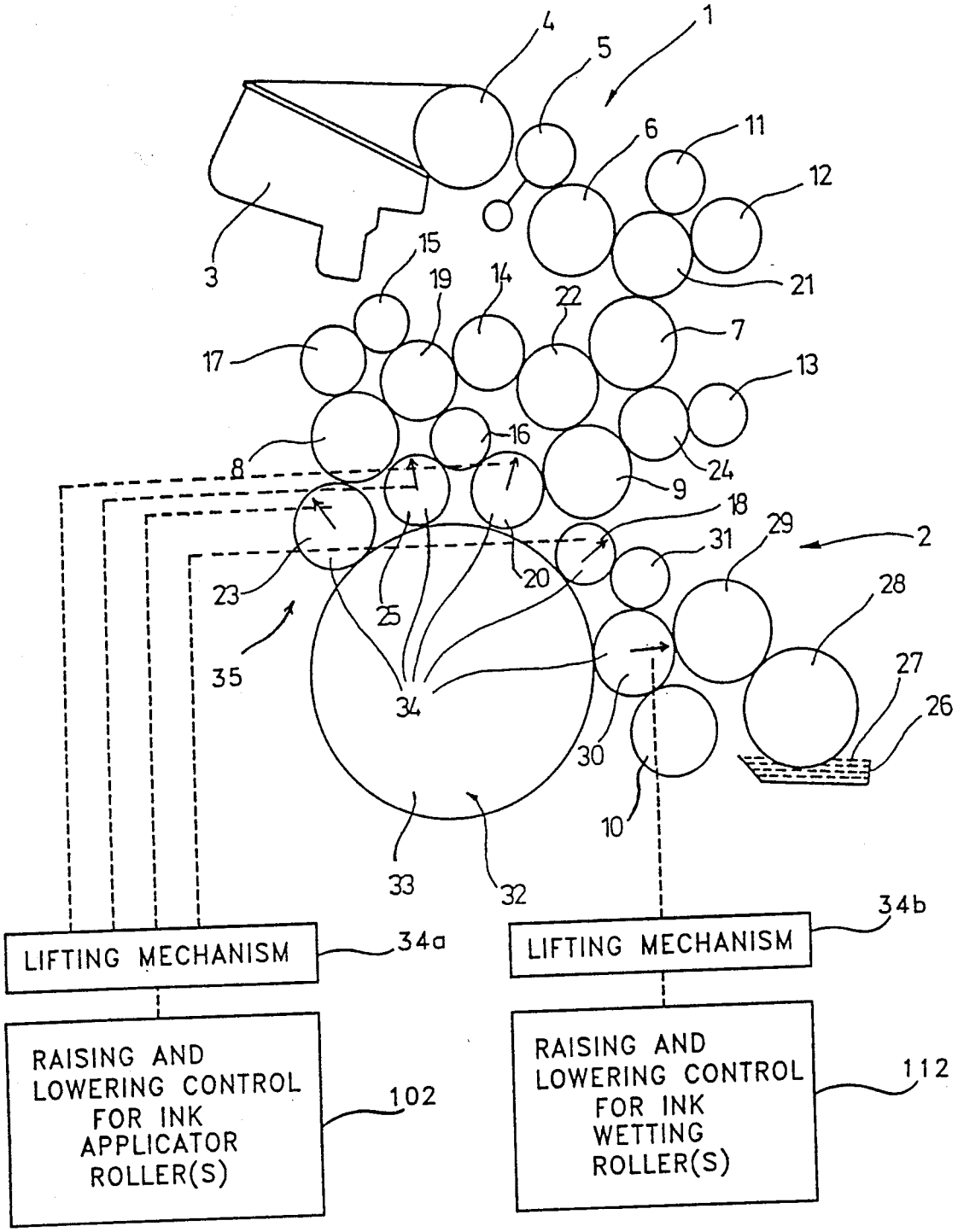
FIG. 2*a* is a schematic diagram, similar to FIG. 2, with a lifting mechanism shown.
Figure 2:
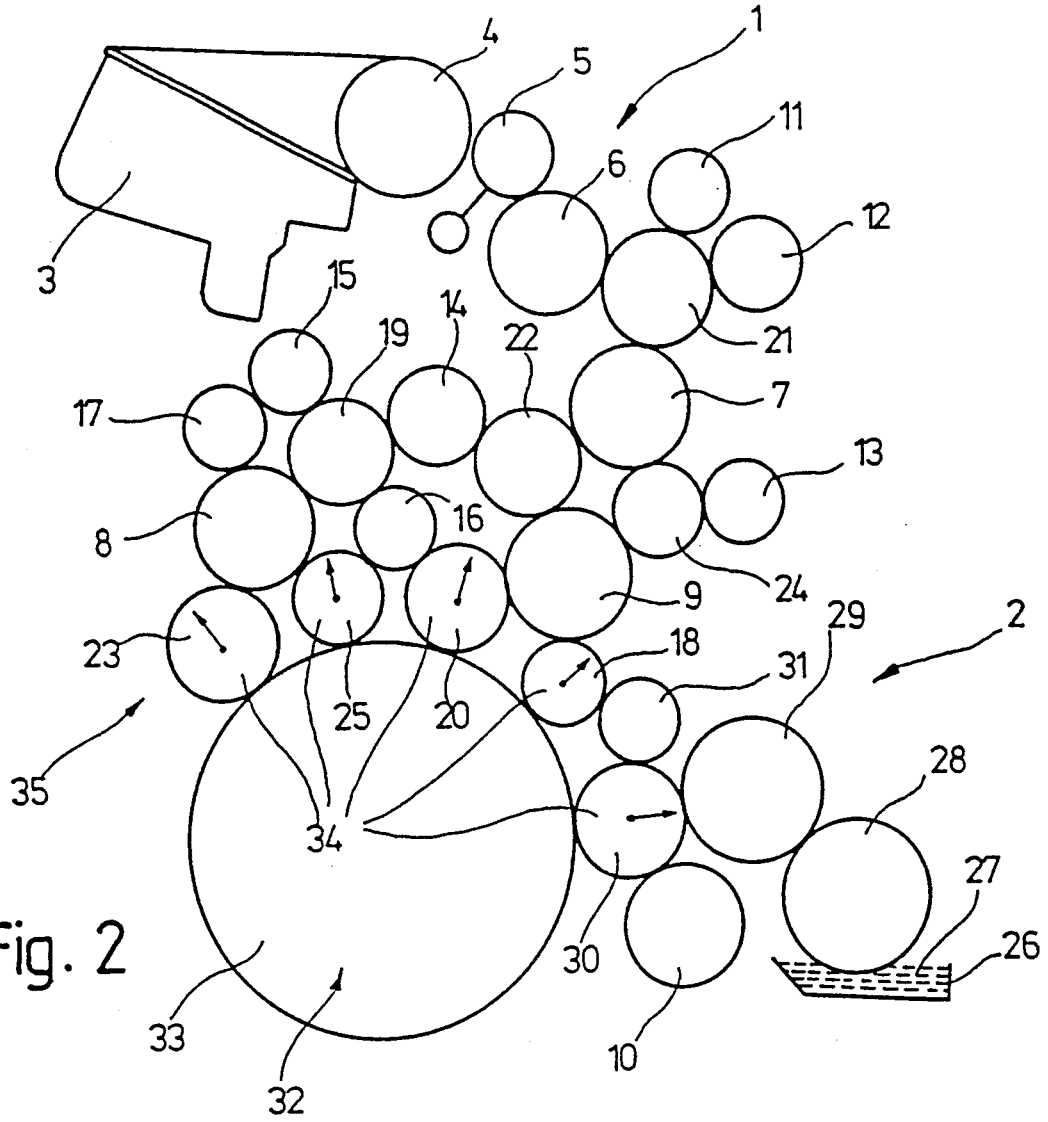
FIG. 2 is a schematic diagram, similar to the arrangement illustrated in FIG. 1, indicating however one possibility for moving the applicator rollers into noncontacting positions.

As shown in FIGS. 1 and 2, the transfer of ink and wetting agent to the printing plate (or printing forme 32) from the inking unit 1 and the wetting unit 2, respectively, is accomplished by the rubber rollers 18, 20, 23, 25 and 30, which are, therefore, also designated as applicator rollers 34.

The offset printing press is further provided with a control apparatus 35 (shown more fully in FIG. 2*a*), which makes possible the movement of the applicator rollers 34 towards and away from the printing forme 32.

In FIG. 2*a*, lifting mechanisms 34*a* and 34*b* are shown which lift the rollers 18, 20, 25, 23, and the roller 30, respectively. Raising and lowering controls 102 and 112 control the operation of the lifting mechanisms 34*a* and 34*b*, respectively, according to the various embodiments of the invention described herein.

Mechanisms which can effect, selectively, a relative separation or a relative contacting between a pair of rollers or a set of rollers are well known in the art and are therefore not described in detail herein. For example, Published German Patent Application No. 15 61 100, discussed above, discloses an inking unit for rotary printing presses having a controllable lifting mechanism for separating particular groups of rollers. In particular, there is disclosed a mechanism for the separation of a group of ink applicator rollers from a plate cylinder. Moreover, as discussed hereafter, U.S. Pat. No. 3,869,983, issued to Garber and entitled "Variable Repeat-Length Web Press", discloses an apparatus for moving one roller toward and away from a second roller.

Figure 3:
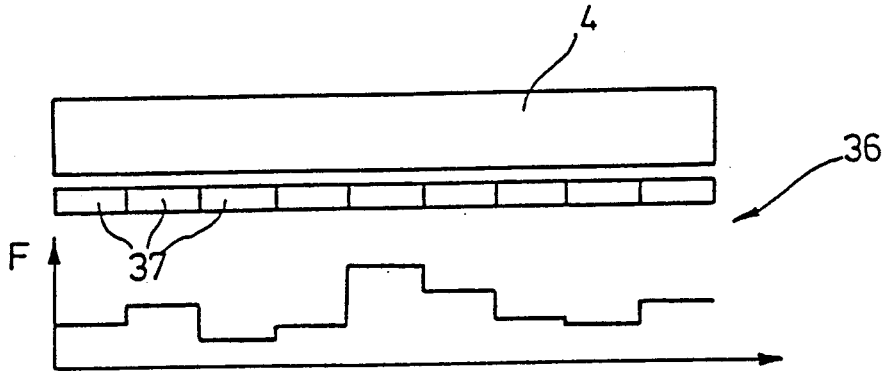
FIG. 3 is a schematic diagram of an ink metering apparatus, as well as a schematic diagram of an ink profile generated thereby.

Adjacent the ink pan 3 there is provided an ink metering apparatus 36, which is schematically illustrated in FIG. 3. The ink metering apparatus 36 makes possible, over the length of the ink ductor 4, a zonal adjustment of the lateral ink profile, e.g., like the one illustrated in the diagram in FIG. 3. In each zone 37, the quantity of ink delivered (e.g., the ink layer thickness F) can be set so that it is appropriate for the inking requirements of the image on the printing plate (or printing forme 32).

By means of the control apparatus 35, the applicator rollers can be moved into the contacting position illustrated in FIG. 1, wherein the applicator rollers 34 of the inking unit 1 and of the wetting unit 2 are in contact with the printing plate (or printing form 32) clamped on the plate cylinder 33. In FIG. 2, the arrows corresponding to the applicator rollers 34 indicate that a shift can be made by means of the control apparatus 35, so that there is a separation between the applicator rollers 34 and the convex surface of the plate cylinder 33, and therefore, the surface of the printing plate clamped thereon.

According to the invention, before the beginning of printing, and in particular during the admission of the ink or during an interruption of the printing run, in particular during jams and/or blanket washing processes, the applicator rollers 34 remain in the contact position with the plate cylinder 33, as shown in FIG. 1. This generates an ink profile close to that required for the printing run. This has the advantage that when the printing is begun or resumed, the desired ink profile corresponding to the image can be achieved in the shortest possible time, so that optimal, essentially waste-free printing results can be achieved. The contact position can also be assumed by the applicator rollers 34 only temporarily, that is, during only a portion of the admission of the ink or of an interruption in the printing process.

WORKING EXAMPLES

Figure 4:
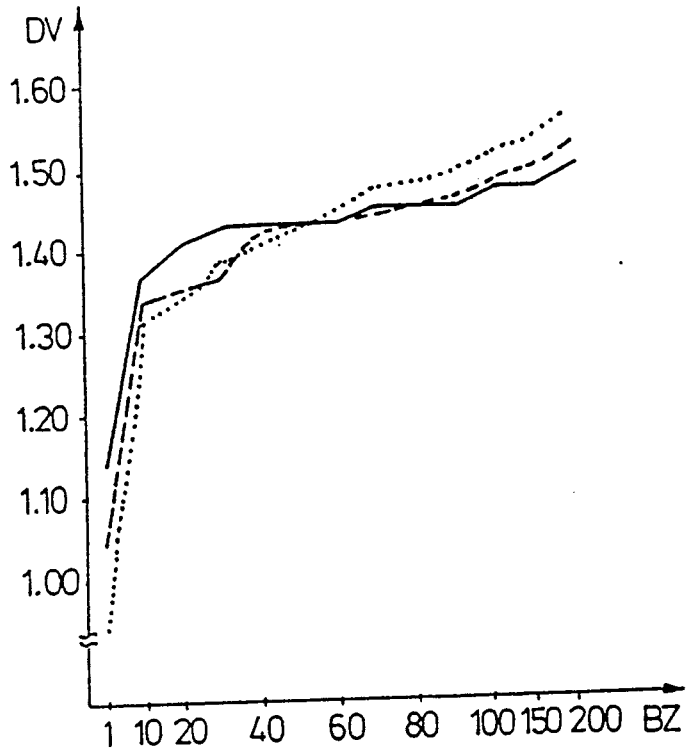
FIG. 4 is a plot illustrating the average full tone density established after the start of printing.
Figure 5:
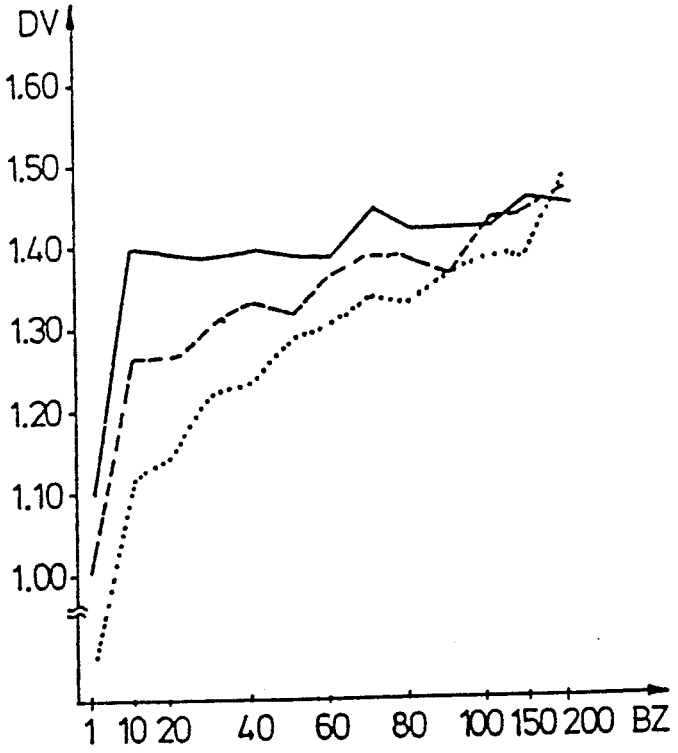
FIG. 5 is a plot, like FIG. 4, showing a zone of the ink metering apparatus with a high ink feed.
Figure 6:
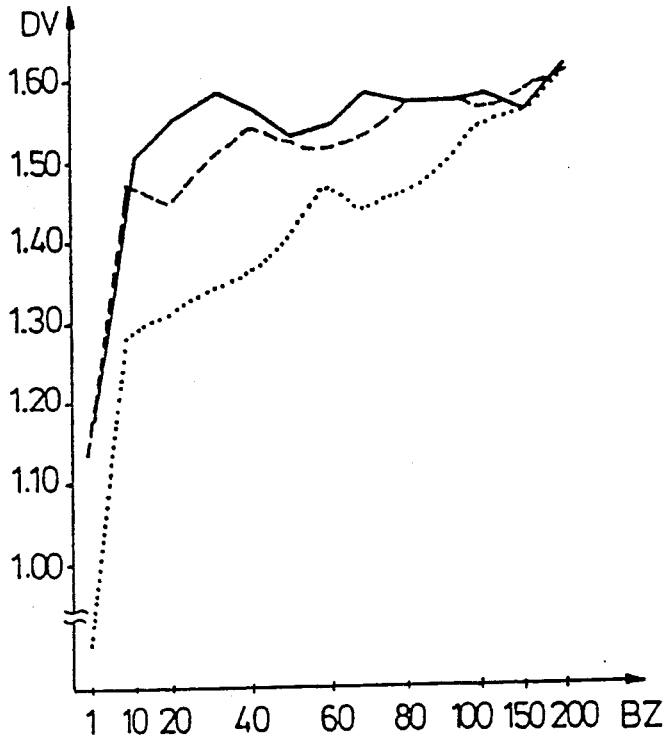
FIG. 6 is a plot, as in FIG. 5, of a zone with a low ink feed.

By way of example, FIGS. 4, 5 and 6 are plots derived from ink admission (or ink profile establishment) tests, in which the full tone density DV is plotted on the ordinate and the number of sheets produced after the beginning of printing (the sheet count: BZ) is plotted on the abscissa. The solid-line curves set forth in FIGS. 4 to 6 show the full tone density DV when the ink profile has been set, and when an ink admission period lasting 6 minutes has been conducted. According to the invention, during the ink admission, the applicator rollers 34 shown in FIG. 1 are in their contacting position to produce the results shown by the solid-line curves. This contact can be continuous, i.e., it can last for the entire duration of the ink admission period, or the contact can be temporary, i.e., lasting only a portion of the ink admission period. Additionally, depending on the current conditions, different periods of contact are also conceivable. The contact position can also be continued for only a determined number of machine revolutions. During this admission time or period of contact, the quantity of wetting agent delivered is increased as follows: beginning: 33.3%, then 55.5%, the final 2 minutes 88.8% and finally (i.e., during the printing run) 100%.

In contrast, the dashed curves set forth in FIGS. 4 to 6, show the full tone density DV produced according to processes of the prior art, i.e., 6 minutes of ink admission and an adjustment of the ink metering apparatus 36 according to the printing run profile. Moreover, according to the processes known in the prior art, and shown by the dashed curves in FIGS. 4 to 6, the applicator rollers 34 are moved into the position where they are in contact with the plate cylinder 33 only at the beginning of printing. Additionally, the amount of wetting agent fed is 100%.

Finally, the dotted curves in FIGS. 4 to 6 also show the full tone density DV according to other known processes of the prior art, that is, an ink admission time of 6 minutes, the ink profile is initially uniform over the entire printing width, and the printing run profile is established only after 6 minutes have passed.

In FIG. 4, the average value of the full tone density DV is shown as measured over all zones 37. It is apparent that by means of the process according to the invention, the curve quickly approaches a final value after a relatively few sheets, for example 40, while, with the process of the prior art, the final value is reached only after a significantly greater number of sheets. In the range of 100 to 200 sheets, all 3 curves still exhibit an ascending tendency of the full tone density DV, but the curve ascent of the process according to the invention is the smallest of the three.

The diagram in FIG. 5 shows the full tone density DV of a certain zone 37, which, on account of the image, requires a relatively large amount of ink. While, with the processes of the prior art, the full tone density DV increases only slowly after the beginning of printing, with the process according to the invention, it reaches the final value after relatively few impressions.

The diagram in FIG. 6 shows the full tone density DV of a zone 37 which requires only a small amount of ink. Here too, it is apparent that the final value of the full tone density DV corresponding to the printing run status is achieved with the process according to the invention significantly earlier than is the case with the processes of the prior art.

Figure 7:
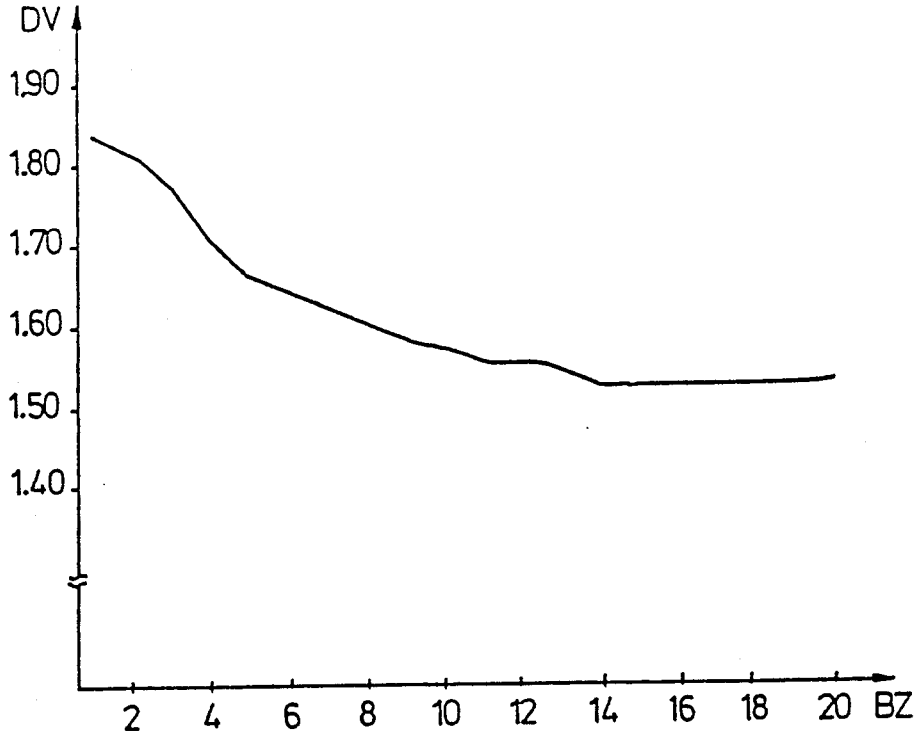
FIG. 7 is a plot of the full tone density following a paper jam.

The diagram in FIG. 7 shows the curve of the full tone density DV as a function of the number of sheets BZ on the occasion of a paper jam, i.e., an interruption of the printing run. During the jam, the rotating applicator rollers 34, in accordance with, the invention, remain in contact with the rotating plate cylinder 33. The interruption lasts 6 minutes, and during that time, the wetting agent feed is increased from 44.4% to 55.5% and finally to 66.6%. During the start-up phase, it is 66.6%, and finally reaches 100% in the printing run condition. It is apparent that the full tone density DV is quickly approaching the final value required for the printing run process after approximately 14 sheets.

Figure 8:
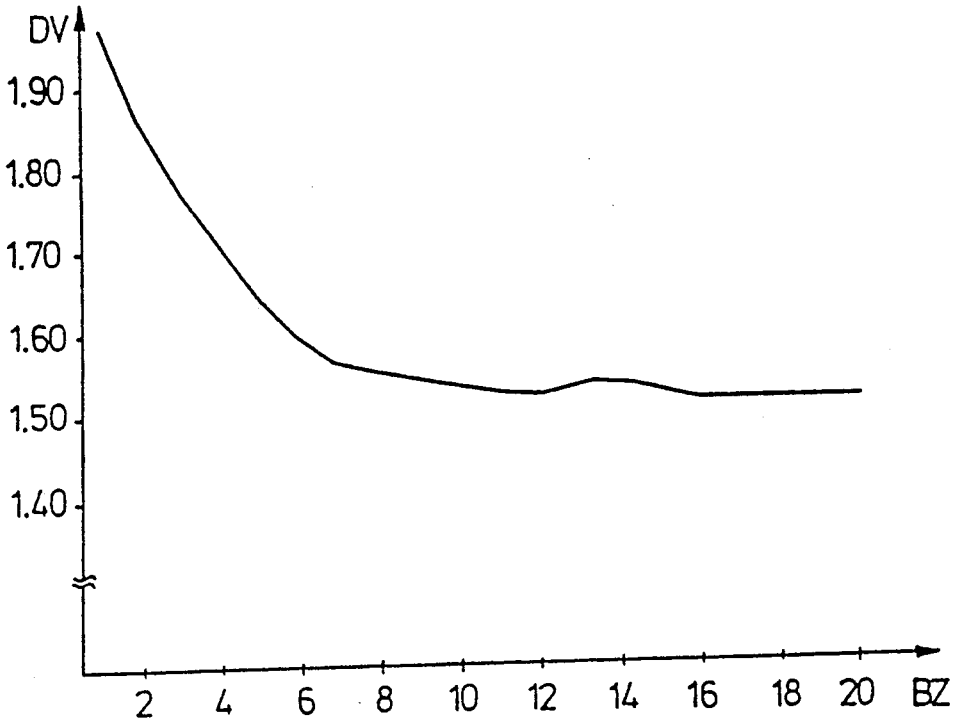
FIG. 8 is a plot, as in FIG. 7, following a stoppage in the feeding of paper to be printed.
Figure 9:
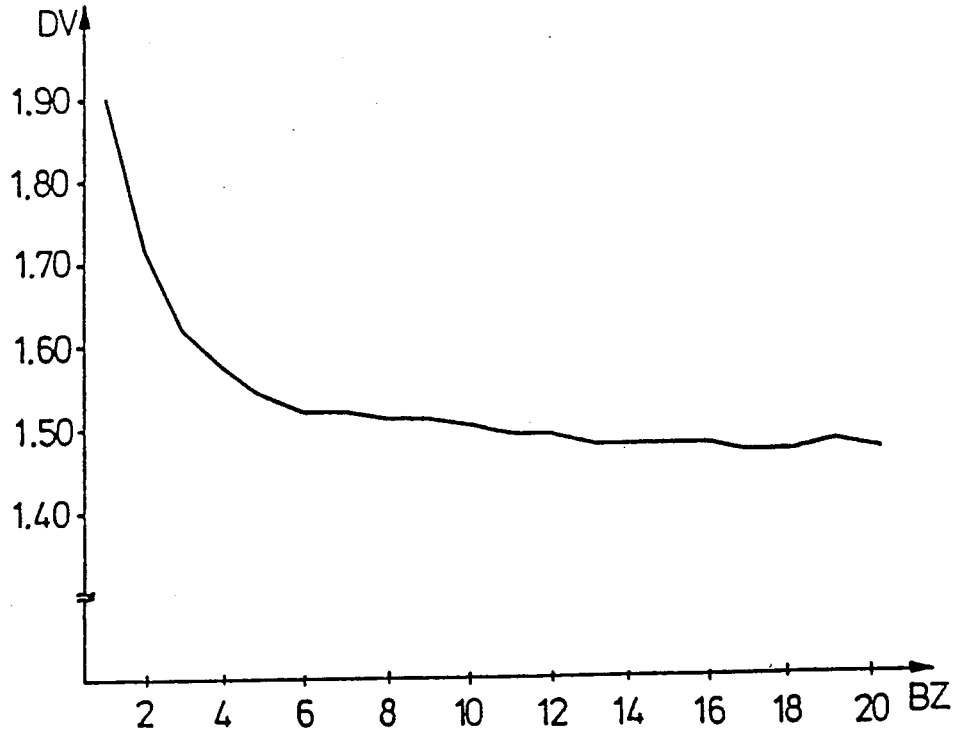
FIG. 9 is a plot, as in FIG. 8, with an excess wetting process.

FIGS. 8 and 9 show the curve of the full tone density DV following a paper feed jam, i.e., an interruption of the printing run. In both cases, during the jam, the applicator rollers 34, in accordance with the invention, remain in contact with the plate cylinder 33. In the test illustrated in FIG. 8, the start-up occurs after 16 revolutions. This is also true for the test illustrated in FIG. 9, but here, shortly before the start-up, an excess wetting is performed. In both cases, the required full tone density DV is achieved after approximately 15 sheets following the resumption of printing operations.

FIGS. 4–9 illustrate impressively that, by means of an offset printing press method and/or apparatus according to the invention, an ink profile close to that required for the printing run can be achieved in an extremely short period of time, so that as little paper as possible is wasted.

Figure 12:
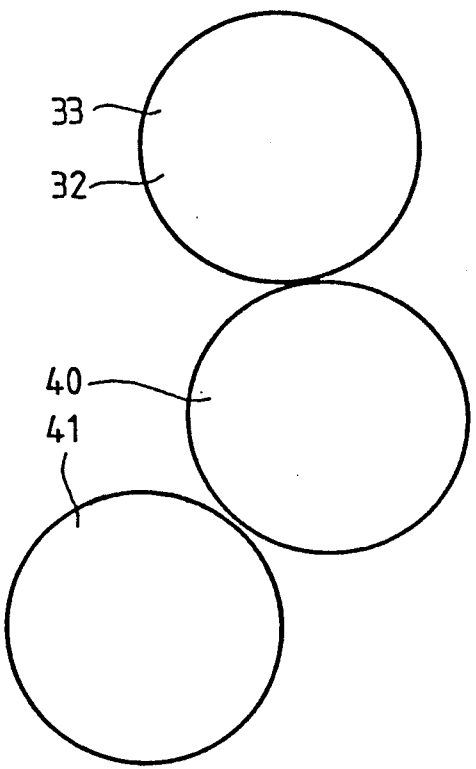
FIG. 12 is a schematic diagram, as in FIG. 11, but with the offset printing press in the printing run position.
Figure 11:
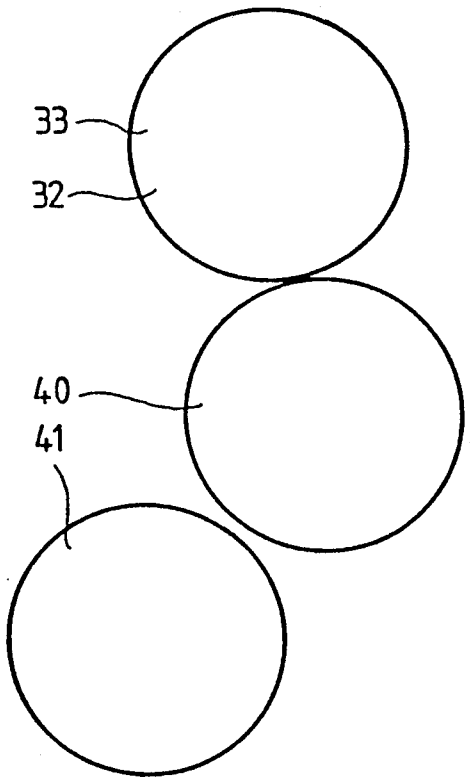
FIG. 11 is a schematic diagram, as in FIG. 10, but during the inking of the blanket.

In addition to the measures described above, simultaneous with or subsequent to the inking of the printing forme 32, the blanket of a blanket cylinder 40 can also be inked. This aspect of the invention is schematically illustrated in FIGS. 10 to 12.

Figure 10:
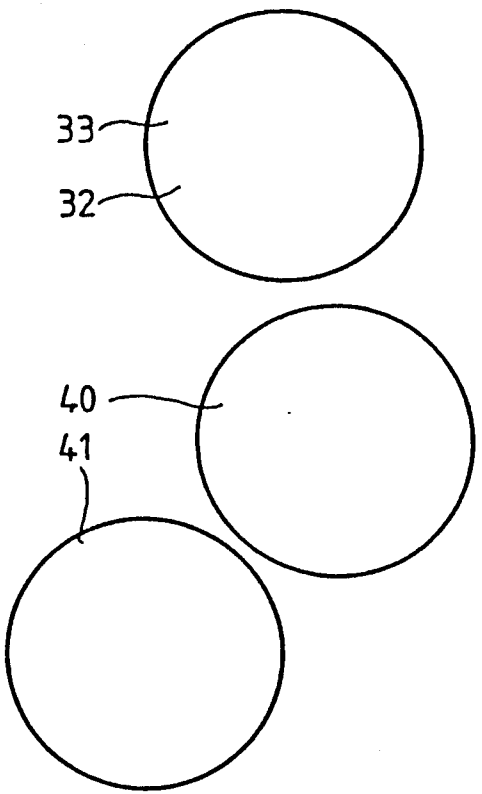
FIG. 10 is a schematic diagram showing the arrangement of a plate cylinder, a blanket cylinder and a printing cylinder, before the inking of a rubber blanket of the blanket cylinder.

FIG. 10 shows the plate cylinder 33, as well as a blanket cylinder 40 and a printing cylinder 41 of an offset printing press. In FIG. 10, these cylinders are shown in their positions before the beginning of printing. The plate cylinder 33 and the blanket cylinder 40 are spaced at some distance from one another. The blanket cylinder 40 and printing cylinder 41 are also spaced at a slight distance from one another. The distance between the blanket cylinder 40 and the printing cylinder 41 is coordinated with the thickness of the material to be printed (e.g. paper). The adjustment to the printing material thickness is done by means of a so-called "print feed adjustment". Print feed adjustment mechanisms for adjusting the distance between a blanket cylinder and a printing cylinder are well known in the prior art and are, therefore, not described in detail herein. For example U.S. Pat. No. 3,869,983, issued to Garber and entitled "Variable Repeat-Length Web Press" discloses an apparatus for moving an impression roller toward and away from a printing roller. The print feed adjustment preferably has an electrical adjustment mechanism for the positioning according to the thickness of the material to be printed. To be able to ink the blanket of the blanket cylinder 40 simultaneous with or subsequent to the inking of the printing forme 32, the position in FIG. 11 is assumed. This is a quasi-operating position, but the printing operation is not initiated, and in contrast to the normal printing run position, the blanket cylinder 40 assumes a position in which it is separated from the printing cylinder 41 However, the printing forme 32 and the blanket cylinder 40 are in contact with one another, so that the inking of the blanket can be carried out. The separation between the blanket cylinder 40 and the printing cylinder 41 is preferably accomplished by means of the above-mentioned print feed adjustment.

As mentioned above, the print feed adjustment is moved by means of the electrical adjustment out of its customary working range for a paper thickness adjustment, so that there is no contact between the blanket cylinder 40 and the printing cylinder 41. This also represents a new use of the print feed adjustment mechanisms known in the prior art. The inking of the blanket takes place during a few revolutions of the corresponding cylinder. Once this has occurred, the transition to the actual printing position can be made. In other words, the printing run position in FIG. 12 is assumed, wherein the plate cylinder 33 is in contact with the blanket cylinder 40, and where there is a relatively small separation (not readily visible in FIG. 12) corresponding to the paper thickness adjustment between the blanket cylinder 40 and the printing cylinder 41.

Figure 13:
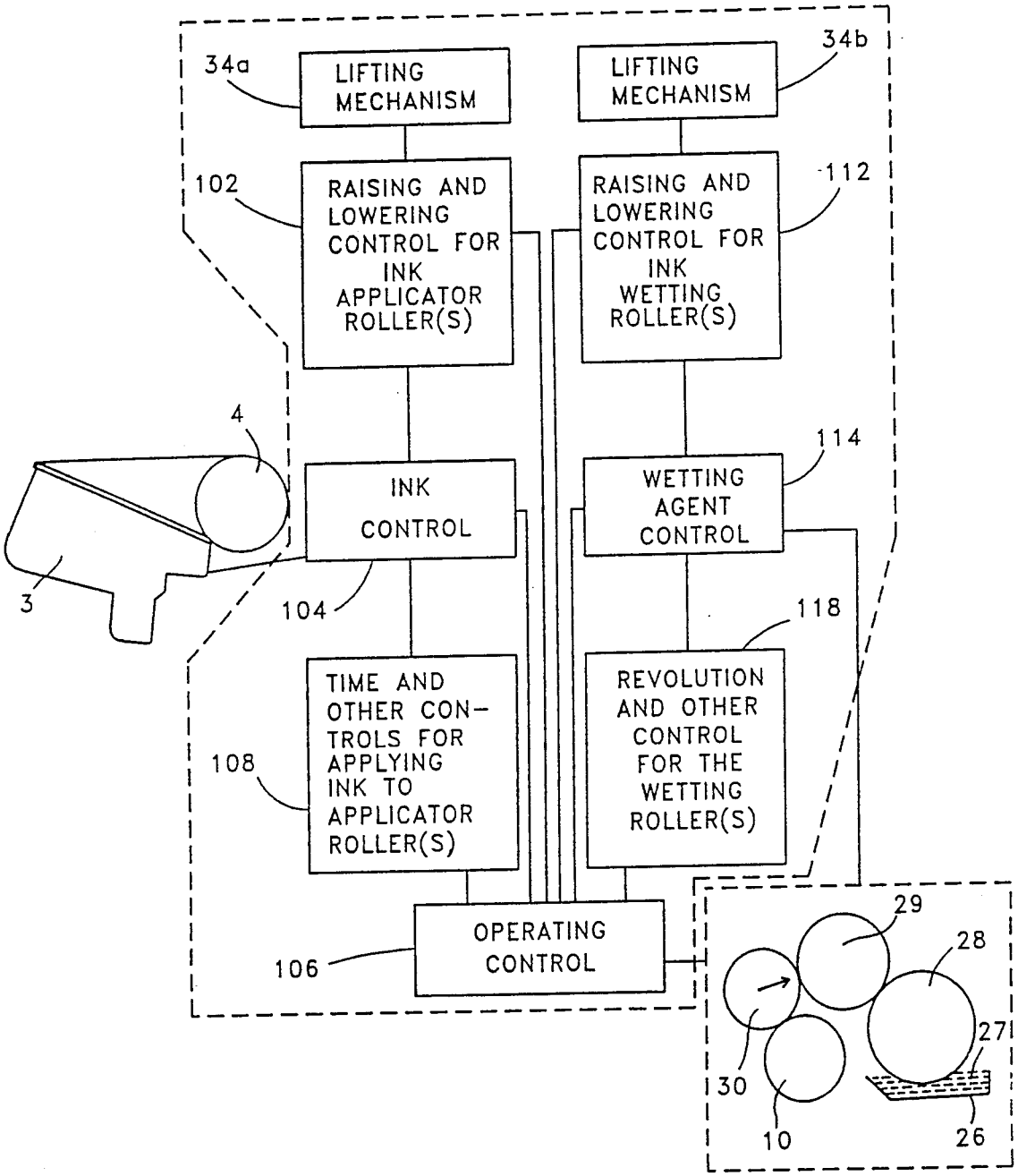
FIG. 13 shows the control system for the printing press.

Now referring to FIG. 13, a control circuit is shown, together with its component control functions and circuitry in block diagram form. Connected to the lifting mechanism 34*a* is a raising and lowering control 102 for the ink applicator rollers. An ink control 104 is provided which receives signals from the raising and lowering control 102 for the ink applicators and also from an overall operating control 106. Signals are also provided to the ink control 104 from a control circuitry 108 which controls the times and other controls for applying ink to the applicator rollers. The ink control 104 controls the ink pan 3 and the ink ductor 4. The lifting mechanism 34*b* is connected to an analogous raising and lowering control 112 for the wetting rollers. This raising and lowering control 112 for the wetting rollers is connected to the overall operating control 106 and also to a wetting agent control 114. The wetting agent control 114 controls the distributing cylinder 10, the rubber roller 30, the metering roller 29, and the fountain roller 28, which are part of the printing press. Connected to the wetting agent control 114 is a control circuitry 118 which controls the revolutions and other controls for the wetting agent rollers. Just as the overall operating control 106 is similarly connected to the control circuitry 108, the overall operating control 106 is connected to the control circuitry 118. The operating control 106 is also connected to and receives signals from the printing press.

Control systems for controlling various aspects of the operation of an offset printing press, such as, for example, the timings and quantity of various fluid flows, the speed of rotation of various rollers and the timing and degree of separation between specific rollers in such printing presses are well known. For example, the publication entitled "Heidelberg CPC", published by Heidelberger Druckmaschinen AG, D-6900 Heidelberg (Publication No. HN2/43.e) describes such a control system for effecting these various functions and is well known in the art. One aspect of the control system described in this Heidelberg Publication is disclosed in German Published Patent Application No. 37 06 695 discussed above.

Still further, Heidelberg Publication HN1/48.e published by Heidelberger Druckmaschinen AG, D-6900 Heidelberg describes another such control system referred to in the art as the "CPTronic" system, which utilizes fully digitized technology for press control monitoring and diagnoses.

In summary, one feature of the invention resides broadly in an offset printing machine with a wetting unit and an inking unit which has an ink metering device to adjust an ink profile, whereby the inking unit and the wetting unit each have at least one applicator roller which can be moved into a position where it is in contact with a printing forme, wherein the applicator rollers 34 for the generation of an ink profile close to that required for the printing run are moved by a control apparatus 35 into a position where they are permanently or temporarily in contact with the printing forme 32 during the admission of the ink which precedes the beginning of printing, or during a jam or blanket washing process which interrupts the printing run.

Another feature of the invention resides broadly in an offset printing machine wherein the control apparatus 35, during the admission of the ink, during the jam or during the blanket washing process, reduces the amount of wetting agent delivered from the amount delivered during the printing run.

Yet another feature of the invention resides broadly in an offset printing machine wherein the control apparatus 35 adjusts the speed of rotation of a fountain roller 28 of the wetting unit 2.

A further feature of the invention resides broadly in an offset printing machine, wherein simultaneous with or subsequent to the inking of the printing forme 32 by the contact between the applicator rollers 34 and the printing forme 32, the blanket of a blanket cylinder 40 is also inked.

A yet further feature of the invention resides broadly in an offset printing machine, wherein the inking of the blanket is performed by the assumption of a contact position between the printing forme 32 and the blanket of the blanket cylinder 40.

Yet another further feature of the invention resides broadly in an offset printing machine, wherein a printing cylinder 41 assumes a position where it is separated from the blanket of the blanket cylinder 40 during the inking of the blanket.

An additional feature of the invention resides broadly in an offset printing machine, wherein to ink the blanket, the offset printing machine assumes its printing operating position, in which a print feed adjustment acting between the blanket cylinder 40 and printing cylinder 41 is moved out of its operating range in the printing run position, so that the blanket of the blanket cylinder 40 and the printing cylinder 41 can assume a position where they are separated from one another.

A yet additional feature of the invention resides broadly in an offset printing machine, wherein the printing forme 32 is a plate cylinder 33 with a printing plate clamped to its convex surface.

A further additional feature of the invention resides broadly in a process for the generation of an ink distribution close to that required for the printing run in the inking unit of an offset printing machine with an ink metering device to set an ink profile, and with applicator rollers of the inking unit and of a wetting unit which can be moved into a position where they are in contact with a printing forme, in particular for the operation of an offset printing machine, wherein the applicator rollers 34 are moved into the contact position during the admission of the ink which takes place before the beginning of printing, or during a jam or blanket washing process which interrupts the printing run.

A yet further additional feature of the invention resides broadly in a process wherein during the admission of the ink, during a jam or blanket washing process, the amount of wetting agent delivered is reduced from the amount delivered during the printing run.

Another further additional feature of the invention resides broadly in a process, wherein simultaneous with or subsequent to the inking of the printing forme 32 by the contact between the applicator rollers 3 and the printing forme 32, an inking of the blanket occurs by the assumption of a contact position between the printing forme 32 and the blanket of a blanket cylinder 40, whereby a printing cylinder 41 is moved into a position where it is separated from the blanket cylinder 40, in particular by means of a print feed adjustment.

A yet another additional feature of the invention resides broadly in an offset printing machine, wherein the separation of the blanket cylinder 40 and the printing cylinder 41 is performed or reached or maintained or during several revolutions of the blanket cylinder 40.

Another yet further feature of the invention resides broadly in a process wherein the ink metering device is automatically adjusted to achieve the optimal printing run conditions in coordination with the wetting unit control and the applicator rollers 34 by means of an ink control device, as a function of the current operating conditions.

A still further feature of the invention resides broadly in the use of a print feed adjustment acting between a blanket cylinder 40 and a printing cylinder 41 of an offset printing machine, to bring about a separation between the blanket cylinder 40 and the printing cylinder 41 during the inking of the blanket of the blanket cylinder 40 which occurs before the beginning of printing with the printing forme 32.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing operation of the offset printing press, the method including the step of providing the printing press, the printing press comprising a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, said method comprising the steps of:

metering the ink, from said ink reservoir and through said ink metering apparatus, to said ink roller train;

operating said ink roller train to transport the ink metered through said ink metering device to the printing plate mounted on the plate cylinder;

operating said wetting agent roller train to transport the wetting agent from the wetting agent reservoir to the printing plate mounted on the plate cylinder;

during said operation of said ink roller train, and during said operation of said wetting agent roller train, and prior to said printing operation of said printing press, maintaining said at least one ink applicator roller and said at least one wetting agent applicator roller in uninterrupted contact with said printing plate mounted on the plate cylinder for a determinate period of time to thereby transfer fluid from said at least one ink applicator roller and said at least one wetting agent applicator roller to said printing plate;

initiating said printing operation of said printing press;

completing said printing operation of said printing press;

said method comprising the further step of, during the establishment of said ink zone profile, reducing the flow of wetting agent transported from the wetting agent reservoir to the printing plate mounted on the printing cylinder to a flow of wetting agent which is substantially less than the flow of wetting agent transported during the subsequent printing operation of said printing press.

2. The method for establishing an ink zone profile in an offset printing press according to claim 1, wherein the printing press additionally comprises:

a blanket cylinder positioned adjacent said plate cylinder; and blanket cylinder positioning means;

said blanket cylinder positioning means being for moving said blanket cylinder between at least a first position, in which said first position said blanket cylinder is in a contacting relationship with said plate cylinder, and a second position, in which said second position said blanket cylinder is in a non-contacting relationship with said plate cylinder; and wherein said method comprises the additional step of:

inking said blanket cylinder by contacting said blanket cylinder with said plate cylinder, following the initiation of contact of said at least one ink applicator roller and said at least one wetting agent applicator roller with said printing plate, and prior to said printing operation of said printing press.

3. The method for establishing an ink zone profile in a offset printing press according to claim 2, said method further comprising the additional steps of:

maintaining said at least one wetting agent applicator roller in contact with said printing plate;

rotating said at least one wetting agent applicator roller a predetermined number of rotations prior to initiating said printing operation of said printing press; and completing said printing operation of said printing press.

4. The method for establishing an ink zone profile in a offset printing press according to claim 1, wherein said transferring of fluid from said at least one ink applicator roller and said at least one wetting agent applicator roller continues for a period of time in the range of about 6 minutes prior to feeding paper through said printing press.

5. The method for establishing an ink zone profile in a offset printing press according to claim 3, wherein said transferring of fluid from said at least one ink applicator roller and said at least one wetting agent applicator roller continues for a period of time in the range of about 6 minutes prior to feeding paper through said printing press.

6. The method for establishing an ink zone profile in an offset printing press according to claim 5, wherein said offset printing press additionally comprises wetting agent fountain rollers means for transferring the wetting agent from said wetting agent reservoir to said wetting roller train, and wherein said method additionally comprises the further step of varying the rotational speed of said wetting agent fountain roller means during the establishment of said ink zone profile.

7. The method for establishing an ink zone profile in an offset printing press according to claim 2, wherein said offset printing press additionally comprises a printing cylinder and selective adjustment means for adjusting between a first position wherein said blanket cylinder and said printing cylinder are in a contacting relationship and a second position wherein said blanket cylinder and said printing cylinder are spaced from one another in a noncontacting relationship, and wherein, during the inking of said blanket cylinder by the contact of said blanket cylinder with said plate cylinder, said blanket cylinder and said printing cylinder are in said second position, spaced from one another in said noncontacting relationship.

8. The method for establishing an ink zone profile in an offset printing press according to claim 7, wherein said selective adjustment means comprises print feed adjustment means.

9. A method for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing operation of the offset printing press, the method including the step of providing the printing press the printing press comprising a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, said method comprising the steps of:

metering the ink, from said ink reservoir and through said ink metering apparatus, to said ink roller train;

operating said ink roller train to transport the ink metered through said ink metering device to the printing plate mounted on the plate cylinder;

operating said wetting agent roller train to transport the wetting agent from the wetting agent reservoir to the printing plate mounted on the plate cylinder;

during said operation of said ink roller train, and during said operation of said wetting agent roller train, and prior to said printing operation of said printing press, maintaining said at least one ink applicator roller and said at least one wetting agent applicator roller in uninterrupted contact with said printing plate mounted on the plate cylinder for a determinate period of time to thereby transfer fluid from at least one of said at least one ink applicator roller and said at least one wetting agent applicator roller to said printing plate;

initiating said printing operation of said printing press; and completing said printing operation of said printing press;

said method comprising the further step of, during the establishment of said ink zone profile, reducing the flow of wetting agent transported from the wetting agent reservoir to the printing plate mounted on the printing cylinder to a flow of wetting agent which is substantially less than the flow of wetting agent transported during the subsequent printing operation of said printing press;

wherein the printing press additionally comprises:

a blanket cylinder positioned adjacent said plate cylinder; and blanket cylinder positioning means;

said blanket cylinder positioning means being for moving said blanket cylinder between at least a first position, in which said first position said blanket cylinder is in a contacting relationship with said plate cylinder, and a second position, in which said second position said blanket cylinder is in a noncontacting relationship with said plate cylinder; and wherein said method comprises the additional step of:

inking said blanket cylinder by contacting said blanket cylinder with said plate cylinder, following the initiation of contact of said at least one of said at least one ink applicator roller and said at least one wetting agent applicator roller with said printing plate, and prior to said printing operation of said printing press;

said method further comprising the additional steps of:

maintaining said at least one wetting agent applicator roller in contact with said printing plate;

rotating said at least one wetting agent applicator roller a predetermined number of rotations prior to initiating said printing operation of said printing press; and completing said printing operation of said printing press;

wherein said transferring of fluid from at least one of said at least one ink applicator roller and said at least one wetting agent applicator roller continues for a period of time in the range of about 6 minutes prior to feeding paper through said printing press;

wherein said offset printing press additionally comprises wetting agent fountain rollers means for transferring the wetting agent from said wetting agent reservoir to said wetting roller train, and wherein said method additionally comprises the further step of varying the rotational speed of said wetting agent fountain roller means during the establishment of said ink zone profile;

wherein said offset printing press additionally comprises a printing cylinder and selective adjustment means for adjusting between a first position wherein said blanket cylinder and said printing cylinder are in a contacting relationship and a second position wherein said blanket cylinder and said printing cylinder are spaced from one another in a noncontacting relationship, and wherein, during the inking of said blanket cylinder by the contact of said blanket cylinder with said plate cylinder, said blanket cylinder and said printing cylinder are in said second position, spaced from one another in said noncontacting relationship; and wherein said selective adjustment means comprises print feed adjustment means.

10. An offset printing press control for establishing an ink zone profile in an offset printing press, the printing press being for the production of successive prints of an image provided on a printing plate, the successive prints of the image being formed by the deposition of an ink on a printing medium during a printing operation of the offset printing press, the ink zone profile being established in the printing press prior to the execution of the printing press run, the printing press comprising a plate cylinder for receiving the mounting thereon of the printing plate, an ink reservoir for supplying the ink, an ink roller train comprising at least one ink applicator roller for transferring at least a portion of the ink supplied by the ink reservoir to the printing plate mounted upon the plate cylinder, an ink metering apparatus for metering ink from the ink reservoir to the ink roller train, a wetting agent reservoir for supplying a wetting agent, and a wetting train comprising at least one wetting agent applicator roller for transferring at least a portion of the wetting agent supplied by the wetting agent reservoir to the printing plate mounted upon the printing cylinder, said offset printing press control comprising:

means for metering the ink, from the ink reservoir and through said ink metering apparatus, to said ink roller train;

means for operating said ink roller train to transport the ink metered through said ink metering device to the printing plate mounted on the plate cylinder;

means for operating said wetting agent roller train to transport the wetting agent from the wetting agent reservoir to the printing plate mounted on the plate cylinder;

control means for retracting at least one of said at least one ink applicator roller and said at least one wetting agent applicator roller from said printing plate, said control means having additional control means for contacting at least one of said at least one ink applicator roller and said at least one wetting agent applicator roller with said printing plate;

means for maintaining said at least one ink applicator roller and said at least one wetting agent applicator roller in uninterrupted contact with said printing plate mounted on the plate cylinder for a determinate period of time and for transferring fluid from at least one of said at least one ink applicator roller and said at least one wetting agent applicator roller to said printing plate, said determinate period of time being during the establishment of said ink zone profile and prior to a printing operation of the offset printing press;

further control means for initiating said printing operation of said printing press; and said offset printing press control further comprising means for, during the establishment of said ink zone profile, reducing the flow of wetting agent transported from the wetting agent reservoir to the printing plate mounted on the printing cylinder to a flow of wetting agent which is substantially less than the flow of wetting agent transported during the subsequent printing operation of said printing press.

11. The offset printing press control for establishing an ink zone profile in an offset printing press according to claim 10, further comprising means for, during the establishment of said ink zone profile, reducing the flow of wetting agent transported from the wetting agent reservoir to the printing plate mounted on the printing cylinder to a flow of wetting agent which is substantially less than the flow of wetting agent transported during the subsequent printing operation of said printing press.

12. The offset printing press control for establishing an ink zone profile in an offset printing press according to claim 11, wherein the printing press additionally comprises:

a blanket cylinder positioned adjacent said plate cylinder;

blanket cylinder positioning means;

said blanket cylinder positioning means being for moving said blanket cylinder between at least a first position, in which said first position said blanket cylinder is in a contacting relationship with said plate cylinder, and a second position, in which said second position said blanket cylinder is in a noncontacting relationship with said plate cylinder; and wherein said offset printing press control further comprises:

means for inking said blanket cylinder by contacting said blanket cylinder with said plate cylinder, following the initiation of contact of said at least one ink applicator roller and said at least one wetting agent applicator roller with said printing plate, and prior to said printing operation of said printing press.

13. The offset printing press control for establishing an ink zone profile in a offset printing press according to claim 12, further comprising:

means for maintaining said at least one wetting agent applicator roller in contact with said printing plate;

means for rotating said at least one wetting agent applicator roller a predetermined number of rotations prior to initiating said printing operation of said printing press; and means for completing said printing operation of said printing press.

14. The offset printing press control for establishing an ink zone profile in an offset printing press according to claim 13, wherein said offset printing press additionally comprises wetting agent fountain roller means for transferring the wetting agent from said wetting agent reservoir to said wetting roller train, and wherein said offset printing press control additionally comprises means for varying the rotational speed of said wetting agent fountain roller means during the establishment of said ink zone profile.

15. The offset printing press control for establishing an ink zone profile in an offset printing press according to claim 14, wherein said offset printing press additionally comprises a printing cylinder and selective adjustment means for adjusting between a first position wherein said blanket cylinder and said printing cylinder are in a contacting relationship and a second position wherein said blanket cylinder and said printing cylinder are spaced from one another in a noncontacting relationship, and wherein said offset printing press control additionally comprises means for actuating said selective adjustment means such that, during the inking of said blanket cylinder by the contact of said blanket cylinder with said plate cylinder, said blanket cylinder and said printing cylinder are in said second position, spaced from one another in said noncontacting relationship.

16. The offset printing press control for establishing an ink zone profile in an offset printing press according to claim 15, wherein said selective adjustment means comprises print feed adjustment means.

17. A method for substantially preserving an ink zone profile in a printing press following an interruption in a printing press run, said printing press being for the production, during the printing press run, of successive prints of an image provided on a printing plate, the successive prints of the image being formed by the deposition of an ink on a printing medium, the ink zone profile being established in the printing press prior to the execution of the printing press run, the method including the step of providing the printing press the printing press comprising a plate cylinder for receiving the mounting thereon of the printing plate, an ink reservoir for supplying the ink, at least one ink applicator roller for transferring at least a portion of the ink supplied by the reservoir to the printing plate mounted on the plate cylinder, a wetting agent reservoir for supplying a wetting agent, and at least one wetting agent applicator roller for transferring at least a portion of the wetting agent supplied by the wetting agent reservoir to the printing plate mounted upon the printing cylinder, said method comprising the steps of:

during the substantially preservation of said ink zone profile, and prior to the resuming of said printing press run, maintaining said at least one ink applicator roller and said at least one wetting agent applicator roller in uninterrupted contact with said printing plate mounted on the plate cylinder for a determinate period of time;

transferring fluid from said at least one ink applicator roller and said at least one wetting agent applicator roller to said printing plate; and during the substantially preservation of said ink zone profile, and prior to the resuming of said printing press run, reducing the flow of the wetting agent supplied by the wetting agent reservoir to the printing plate to a flow which is substantially less than the flow of wetting agent supplied by the wetting agent reservoir to the printing plate upon resumption of the printing press run.

* * * * *